US005499579A

United States Patent [19]

Lewis

[11] Patent Number: 5,499,579

[45] Date of Patent: Mar. 19, 1996

[54] DELAY ORDNANCE SYSTEM

[75] Inventor: Donald J. Lewis, Scottsdale, Ariz.

[73] Assignee: Universal Propulsion Company, Inc., Phoenix, Ariz.

[21] Appl. No.: 141,260

[22] Filed: Oct. 22, 1993

[51] Int. Cl.[6] ..... F42B 3/00; F42C 15/40

[52] U.S. Cl. ..... 102/331; 102/215; 102/262

[58] Field of Search ..... 102/215, 218, 102/262, 331

[56] References Cited

U.S. PATENT DOCUMENTS

| | | | |
|---|---|---|---|
| 3,964,395 | 6/1976 | Kaiser et al. | 102/218 |
| 3,967,557 | 7/1976 | Irish, Jr. | 102/70.2 R |
| 4,470,351 | 9/1984 | Farace | 102/232 |
| 4,829,899 | 5/1989 | Wilker et al. | 102/206 |
| 5,097,765 | 3/1992 | Ziemba | 102/218 |
| 5,168,122 | 12/1992 | Furst et al. | 102/262 |
| 5,245,926 | 9/1993 | Hunter | 102/215 |
| 5,335,598 | 8/1994 | Lewis et al. | 102/218 |

*Primary Examiner*—Peter A. Nelson
*Attorney, Agent, or Firm*—Ellsworth R. Roston; Charles H. Schwartz

[57] ABSTRACT

A pancake-configured housing holds first and second printed circuit boards. The first board includes electronic circuitry providing an adjustable timing delay and a first switch manually operated from a position external to the housing. The second board includes a pyrotechnic device and electronic circuitry for firing the device after the adjustable time delay. The second board also includes second switches with arms actuatable to convert such switches from first to second operative states. In the first state, the second switches short circuit the device and an energy storage member (e.g. a capacitor) on the second board and provide an open circuit to the circuitry on the first board. In the second state, the second switches provide a charging of the capacitor, the initiation of the timing through the circuitry in the first board with the first switch closed and the device firing by the capacitor energy after the adjustable delay. The housing has first and second integral fittings preferably oppositely disposed. The first fitting may receive an input mechanism as through a male coupling and the second fitting may receive an output mechanism as through a female coupling. Upon actuation, the input mechanism communicates with the movable arms of the second switches to operate the second switches to the second states. When the pyrotechnic device fires after the adjustable delay, the device actuates the output mechanism through the second fitting. The housing may respectively receive individual ones of different input and output mechanisms through the first and second fittings.

24 Claims, 2 Drawing Sheets

DELAY ORDNANCE SYSTEM

This invention relates to a delay ordnance system. More particularly, the invention relates to a delay ordnance system which includes any one of a plurality of input mechanisms, any one of a plurality of output mechanisms and an electronic timing and firing system adapted to be coupled on a universal basis to individual ones of the input and output mechanisms.

Ordinary systems generally have three (3) separate units: (1) an input mechanism for initiating a timing operation representing a pre-selected delay, (2) a timing and firing system for providing the pre-selected delay and (3) an output mechanism operated by the timing and firing system after the pre-selected delay. The input mechanism may have any one (1) of several different forms, all known in the prior art. For example, the input unit may provide (a) a gas input or a detonation unit, (b) a mechanized input such as a lanyard, (c) an electrical input such as an electrical current, (d) an input based upon the attainment of a particular temperature or (e) an input based upon a particular pressure.

The timing and firing systems in the prior art have generally been pyrotechnic. For example, a material has been combusted for a variable period of time dependent upon the characteristics of the combustible material. Such timing and firing systems have had certain inherent disadvantages. For example, the timing has not been very accurate. Furthermore, the time delay provided by combustible materials has not been very long. The timing and firing systems have also been disadvantageous because they have sometimes deteriorated with time and because they have sometimes provided an output at an inappropriate time to actuate the output unit. Furthermore, the delay times in such systems have not been able to be adjusted. These problems have occurred because the timing and firing systems have been chemical. Such problems have been known to exist in the timing and firing systems of the prior art for a relatively long period of time without any real ability to minimize the problems specified in this paragraph.

The output unit operated by the timing and firing unit may have a number of different forms. For example, the output unit may constitute a cutter for a reefing line or may provide heat from a thermal battery. Generally, the input and output mechanisms have been more advanced in the prior art than the timing and firing systems. Furthermore, there has been no standard relationship between the timing and firing system and individual ones of the input and output mechanisms. In other words, it has been difficult, if not impossible, in the prior art to provide a delay ordnance system in which an electronic timing and firing system can be coupled on a universal basis to any individual one of a plurality of input mechanisms and to any individual one of a plurality of output mechanisms.

Figure 3:
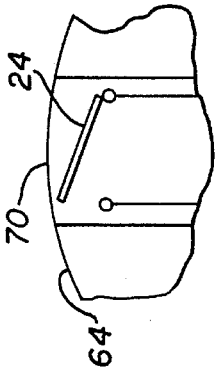

In U.S. Pat. No. 5,335,598 issued on Aug. 9, 1994, for "Timing and Firing Circuitry" and assigned of record to the assignee of record in this application and copending with this application, applicant and Larry C. LaClair disclose and claim a circuit corresponding to the circuit shown in FIG. 1 of this application. This application discloses apparatus incorporating such circuit. This apparatus is shown in FIGS. 2 and 3.

This invention provides a delay ordnance system which overcomes the difficulties specified above. A timing and firing unit provides an accurate delay of a period which is adjustable through a wide range of values such as between a few seconds and twenty four (24) hours. The timing and firing unit is foolproof. In other words, the timing and firing unit can be actuated only by the input mechanism and the output mechanism can be actuated only after the adjustable delay from the time that the input mechanism has been actuated. The timing and firing unit does not deteriorate in its operation even when stored for long periods of time.

The timing and firing unit is disposed in a housing which is provided with a first standard fitting to receive any individual one of a number of input mechanisms and with a second standard fitting to receive any individual one of a number of output mechanisms. The housing for the timing and firing unit is compact and is constructed to insure the timing of the adjustable period after the actuation of the input mechanism and to insure the actuation of the output mechanism after the timing of the adjustable period.

In one embodiment of the invention, a pancake-configured housing holds first and second printed circuit boards. The first board includes electronic circuitry providing the adjustable timing delay .and a first switch manually operated from a position external to the housing. The second board includes a pyrotechnic device and electronic circuitry for firing the device after the adjustable time delay. The second board chip also includes second switches with movable arms actuatable from first to second operative states.

In the first state, the second switches short circuit the device and an energy storage member (e.g. a capacitor) on the second board and provide an open circuit to the electronic circuitry on the first board and provide an open circuit to the circuitry on the first board. In the second state, the second switches provide a charging of the capacitor, the initiation of the timing through the electronic circuitry in the first board with the first switch closed and the device firing by the capacitor energy after the adjustable timing delay.

The housing has first and second integral fittings preferably oppositely disposed. The first fitting may receive an input mechanism as through a male coupling and the second fitting may receive an output mechanism as through a female coupling. Upon actuation, the input mechanism communicates with the movable arms of the second switches to operate the second switches from the first to the second states. When the pyrotechnic device fires after the pre-selected time delay, the device actuates the output mechanism through the second fitting. The housing may respectively receive individual ones of different input and output mechanisms through the first and second fittings.

Figure 1:
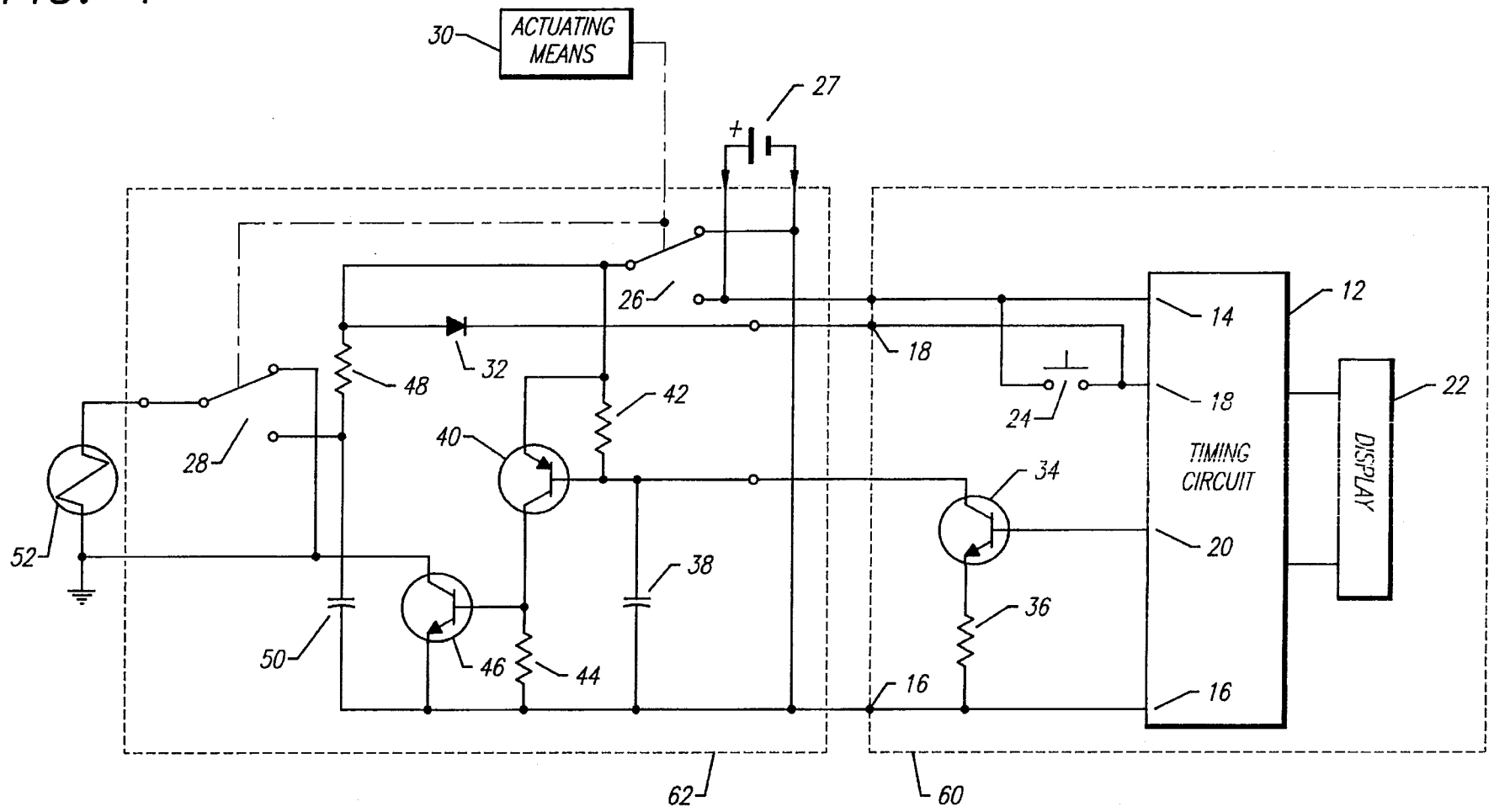
Figure 2:
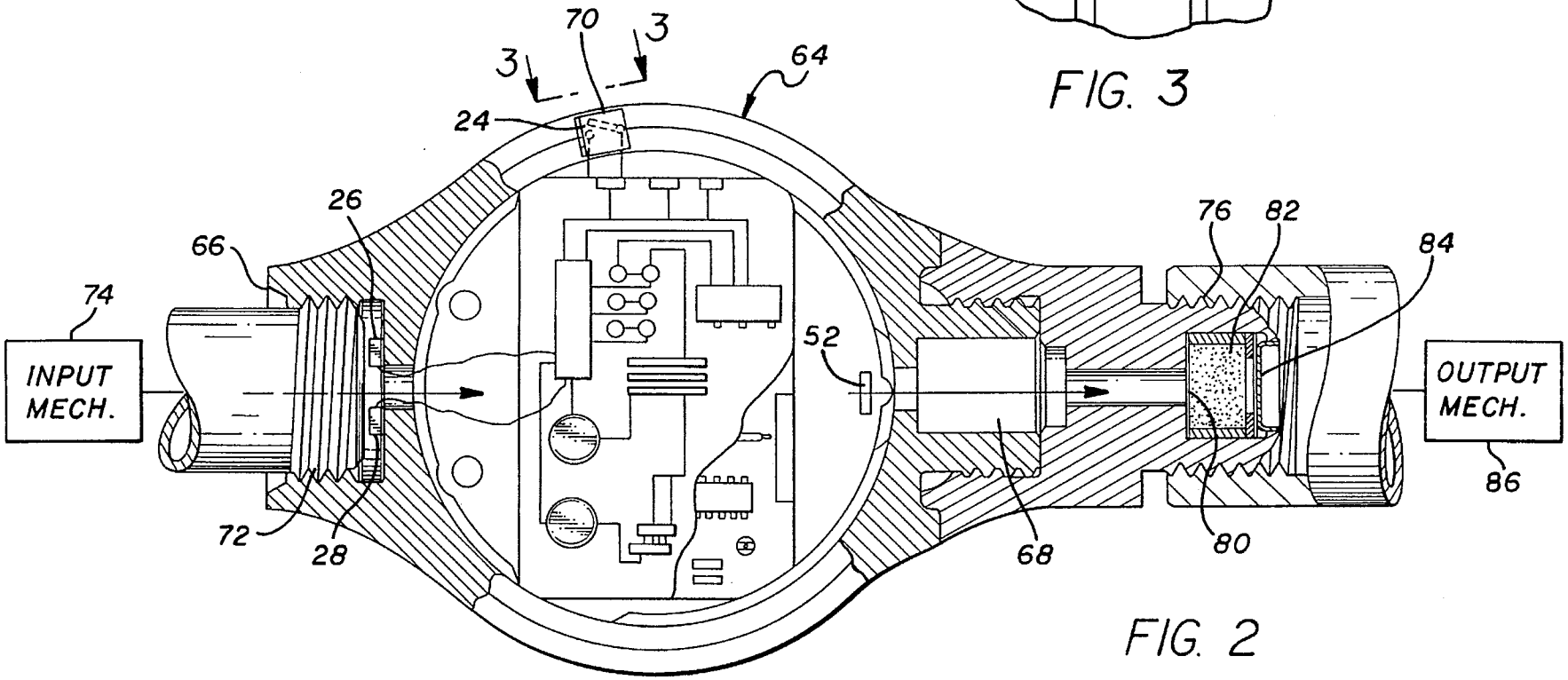

In the drawings:

FIG. 1 is a circuit diagram, partially in block form, of one embodiment of a timing and firing system for a delay ordnance system;

FIG. 2 is a sectional view, partially broken away, of a housing for the timing and firing system shown in FIG. 1 and of fittings extending from the housing for receiving on a universal basis an input mechanism adapted to energize the timing and firing system and an output mechanism adapted to be actuated by the timing and firing system; and FIG. 3 is a sectional view taken substantially on the line 3—3 of FIG. 2 and illustrates in additional detail the construction of a manually operated switch included in the timing and firing system shown in FIG. 1.

One embodiment of a timing and firing system for a delay ordnance system is generally indicated at 10 in the single Figure. The timing system 10 includes a timing circuit indicated in block form at 12. The timing circuit 12 may be formed in a conventional manner. Any different number of timing circuits may be used as the circuit 12. For example, the circuit 12 may constitute a watch circuit provided by the Timex Corporation.

The timing circuit 12 has several different terminals. These include a terminal 14 for receiving a position energizing voltage, a terminal 16 for providing a negative voltage, a terminal 18 for providing a start signal and a terminal 20 for providing an output signal. A display 22 provides a visual indication of the time delay pre-selected to be provided by the timing circuit 12. This time delay may be adjustable.

A manually operated switch 24 has one stationary terminal connected to the start terminal 18 of the timing circuit 12. A second stationary terminal of the switch 24 has a common connection with one stationary terminal of a single-pole double-throw switch 26 and the positive terminal of a battery 27. The movable arm of the switch 26 is ganged to the movable arm of a switch 28. The movable arms of the switches 26 and 28 are normally in the position shown in the single Figure. The movable arms of the switches 26 and 28 are operatively coupled to actuating means shown at 30 in block form in the single Figure. The actuating means may provide an input to the system 10 to initiate the operation of the system 10.

The actuating means 30 may have a number of different forms, all known in the prior art. For example, the actuating means 30 may constitute (a) a gas input or a detonation unit, (b) a mechanized input such as a lanyard, (c) an electrical input such as an electrical current, (d) an input based upon the attainment of a particular temperature or (e) an input based upon a particular pressure. All of these inputs may be converted by means well known in the art to mechanical motions of the movable arms of the switches 24 and 26.

The upper and lower stationary contacts of the switch 26 are respectively common with the positive and negative terminals of a power supply such as a battery 27. The negative terminal of the battery 27 is also connected to the negative terminal 16 in the timing circuit 12. The lower stationary contact of the switch 26 is connected to the positive terminal 14 in the timing circuit 12 and to one of the stationary contacts in the switch 24. The movable arm of the switch 26 is common with the anode of a diode 32 having its cathode connected to the start terminal 18 in the timing circuit 12.

The output signal on the terminal 20 in the timing circuit 12 is introduced to the base of an npn-type transistor 34. The source of the transistor 34 may be common with one terminal of a resistor 36 having a relatively low value such as approximately two hundred ohms (200Ω). A connection is made from the second terminal of the resistor 36 to the negative terminal 16 in the timing circuit 12.

A connection is made from the collector of the transistor 34 to one terminal of a capacitor 38 having a suitable value such as approximately twenty seven thousandths of a microfarad (0.027 μf). The second terminal of the capacitor 38 is common with the negative terminal 16 in the timing circuit 12. The collector of the transistor 34 is also connected to the base of a transistor 40 which may be a PNP transistor. A resistor 42 having a suitable value such as approximately two hundred Kilohms (200 KΩ) is connected between the base and the emitter of the transistor 40. The source of the transistor 40 is common with the movable arm of the switch 26.

A resistor 44 is connected between the collector of the transistor 40 and the negative terminal 16 in the timing circuit 12. The resistor 44 may have a suitable value such as approximately two hundred Kilohms (200 KΩ). A connection is also made from the collector of the transistor 40 to the base of a transistor 46 which may be NPN type. The source of the transistor 46 is common with the negative terminal 16 in the timing circuit 12.

A resistor 48 and a capacitor 50 are in series between the movable arm of the switch 26 and the source of the transistor 46. The resistor 48 may have a suitable value such as approximately three hundred and eighty three ohms (383 Ω). The capacitor 50 may have a suitable value such as approximately sixty eight microfarads (68 μf). The terminal common to the resistor 48 and the capacitor 50 is connected to the lower stationary contact of the switch 28 in the single Figure.

The upper stationary contact of the switch 28 in the single Figure is common with the collector of the transistor 46. A connection is made from the movable arm of the switch 28 to an ungrounded terminal of a pyrotechnic device 52. The other contact of the pyrotechnic device 52 is connected to a ground such as a casing in the timing system 10. When fired, the pyrotechnic device 52 may actuate an output unit (not shown) in a manner well known in the art. For example, the output unit may constitute a cutter for a reefing unit or may provide actuation for a thermal battery.

When the movable arms of the switches 26 and 28 engage the upper stationary contacts of the switches as shown in the single Figure, the switch 26 provides a short circuit across the capacitor 50 and the resistor 44, and the switch 28 provides a short circuit across the pyrotechnic squib 52. This prevents the capacitor 50 from being charged and the pyrotechnic squib 52 from being fired. At the same time, the voltage on the battery 27 is applied to the positive terminal 14 in the timing circuit 12 to provide power to operate the timing circuit.

When the switch 24 is manually closed, the timing circuit 12 provides for an operational checkout of the timing circuit 12. The movable arms of the ganged switches 26 and 28 become moved from the upper position to the lower position by an operation of the actuating means 30 which may constitute any one of a number of different inputs. When the movable arm of the switch 26 engages the lower stationary contact of the switch, a voltage is applied from the battery 27 through the diode 32 to the start terminal 18 in the timing circuit 12. This initiates the timing of the pre-selected period in the timing circuit 12.

Current also flows from the battery 27 through a circuit including the resistance 48 and the capacitor 50 to charge the capacitor 50. The capacitor 50 becomes charged in a relatively short period of time such as less than one tenth of a second (0.1 sec.). The charging of the capacitor 50 prepares the capacitor 50 to be able to fire the pyrotechnic device. It is desirable for the capacitor 50 to be charged in a relatively short time, particularly when the pre-selected timing period measured by the timing circuit 12 is relatively low.

The timing circuit 12 times the pre-selected period. At the end of the pre-selected period, the timing circuit 12 produces a series of pulses on the line 20. These pulses trigger the transistor 34 into a state of conductivity at the same frequency as the pulses. When the transistor 34 becomes conductive, a relatively low voltage is produced on the collector of the transistor 34. This low voltage discharges the capacitor 38. The low voltage is also introduced to the base of the transistor 40 to make the transistor 40 conductive. The pulses are filtered by capacitor 38 as a result of the charging of the capacitor through a circuit including the battery 27, the switch 26 and the base/emitter junction of the transistor 40.

The flow of current through the transistor 40 causes a relatively high voltage to be produced across the resistor 44. This high voltage establishes a state of conductivity in the transistor 46. When the transistor 46 becomes conductive, it has a relatively low impedance. This causes a circuit to be established through the capacitor 50, the switch 28 (in the second state of operation), the pyrotechnic squib 52 and the transistor 46. The capacitor 50 then discharges through the pyrotechnic squib 52 to fire the pyrotechnic squib. The firing of the pyrotechnic squib 52 initiates the operation of an output unit (not shown).

It should be appreciated that the timing and firing system 10 may be disposed on printed circuit boards. One printed circuit board may be formed from the components included within a broken-line rectangle 60 in the single Figure. Such components may be considered to relate to delay circuitry. Another printed circuit board may be formed from the components included within a broken-line rectangle 62 in the single Figure. Such components may be considered to relate to firing circuitry. Each of the printed circuit boards 60 and 62 may be formed in a thin pancake-like configuration having substantially a cylindrical configuration conventional in some printed circuit boards. For example, the diameter of each of the printed circuit boards may be approximately three quarters of an inch (¾") .

The two (2) printed circuit boards 60 and 62 may be disposed in a back-to-back relationship in a housing generally indicated at 64 in FIG. 2 to make the housing compact. The housing 64 may be provided with a generally cylindrical configuration illustratively having a diameter less than approximately one and one half inches (1½") and having an axial length less than approximately one half inch (½"). The housing 64 is provided with open ends 66 and 68 at opposite ends of the generally cylindrical configuration. The movable arms of the ganged switches 26 and 28 are disposed at the open end 66. The pyrotechnic fuse 52 is disposed at the open end 68. An opening 70 is provided in the housing 64 at a position displaced from the open ends 66 and 68. The movable arm of the switch 24 extends through the opening 70 for manual actuation.

A fitting 72 extends from the open end 66, preferably integrally with the housing 64. The fitting 72 may be internally threaded to receive an input mechanism indicated generally at 74. The input mechanism 74 may be externally threaded. The input mechanism 74 may have any one of several different forms. For example, the input mechanism 74 may provide (a) a gas input or a detonation input, (b) a mechanized input such as a lanyard, (c) an electrical input such as an electrical current, (d) an input based upon the attainment of a particular temperature or (e) an input based upon a particular pressure. However, no one of the inputs of the prior art is in a form capable of being coupled on a universal basis to the fitting 72. When the input mechanism 74 is actuated, it produces a force which actuates the movable arms of the switches 26 and 28 from the upper position shown in FIG. 1 to the lower position shown in FIG. 1.

A fitting 76 extends from the open end 68 of the housing 64, preferably externally relative to the housing 64. Preferably, the fitting 76 is disposed at the opposite diametrical end from the fitting 72. The fitting 76 may be externally threaded to distinguish it from the fitting 72. A disc 80 may be disposed in the fitting 76. Combustible material 82 is disposed against the disc 80 and adjacent a disc 84 displaced from the disc 80. Any suitable combustible material well known in the prior art may be used as the material 82.

When the pyrotechnic device 52 is fired, it produces a gas which expands with a sufficient force to rupture the disc 80. The heat from the gas produced by the device 52 then combusts the material 82. The resultant gases produce a rupture in the disc 84. The gases from the material 82 then actuate an output mechanism 86 which is coupled to the fitting 76. For example, the output mechanism 86 may be internally threaded to mate with the fitting 76.

It will be appreciated that the coupling between the fitting 72 and the input mechanism 74 and between the fitting 76 and the output mechanism 86 are only illustrative. For example, the fitting 72 may be internally threaded and the input mechanism 74 may be externally threaded. Similarly, the fitting 76 may be internally threaded and the output mechanism 86 may be externally threaded. It will also be appreciated that other types of couplings than threadings between the housing 64 and the input mechanism 74 between the fitting 76 and the output mechanism 86 also be used without departing from the scope of the invention.

In effect, the discs 80 and 84 and the combustible material 82 may be considered to constitute a gaseous amplifier for amplifying the gaseous expansion provided by the pyrotechnic device 52, thereby insuring the actuation of the output mechanism 86. It will be appreciated, however, that it may be possible to actuate the output mechanism 86 directly from the expanding gases provided by the pyrotechnic device 52.

The output mechanism 86 may have a number of different forms. For example, the output mechanism 86 may constitute a cutter for a reefing line or may provide heat from a thermal battery. However, none of the output mechanisms of the prior art is in a form to be coupled on a universal basis to the fitting 76.

The apparatus constituting this invention has certain important advantages. It provides a timing and firing unit 10 which operates reliably to provide a delay variable through a wide range of values when the input mechanism 74 is actuated. The timing and firing unit 10 can be stored for long periods of time without any deterioration in its capabilities. The timing and firing unit 10 provides a delay which can be pre-selected with great precision through a wide range of values.

The apparatus constituting this invention also has other important advantages. It disposes the timing and firing unit 10 on a pair of printed circuit boards 60 and 62 which are contained within a housing 64. The housing 64 is compact and is in a configuration which provides for easy handling. The housing 64 provides fittings 66 and 72 which are respectively constructed to receive the input mechanism 74 and the output mechanism 86. In this way, the apparatus of this invention provides a delay ordnance system in which any individual one of a plurality of input mechanisms can actuate any individual one of a plurality of output mechanisms after a pre-selected delay.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination for receiving an input from an input mechanism and for providing a housing for an output mechanism, a first switch having first and second operative relationships, a second switch having first and second operative relationships, a pyrotechnic device, an energy source, energy storage means, means for short circuiting the pyrotechnic device in the first operative relationship of the first switch, means for disconnecting the energy source in the first operative relationship of the second switch, means for connecting the energy source and the energy storage means to obtain the storage of energy in the energy storage means in the second operative relationship of the second switch, a third switch having conductive and non-conductive states and normally operative in the non-conductive state, means for preventing a timing period from being initiated in the first operative relationship of the second switch, means for initiating the start of the timing period in the second operative relationship of the second switch and for producing the conductivity of the third switch at the end of the timing period, means for connecting the energy storage means, the first switch, the pyrotechnic device and the third switch in a circuit in the second operative relationship of the second switch and the conductive state in the third switch to obtain a discharge of the energy in the energy storage means through the pyrotechnic device for a firing of the pyrotechnic device, and a housing for holding the first, second and third switches, the energy source, the energy storage means and the pyrotechnic device.

2. In a combination as set forth in claim 1, the housing having a first fitting for receiving the input mechanism and having a second fitting for receiving the output mechanism, the second fitting being different from the first fitting, the third switch constituting a transistor.

3. In a combination as set forth in claim 1, a fourth switch partially extending from the housing for manual actuation, the fourth switch having first and second states of operation dependent upon the manual actuation of the fourth switch, the fourth switch being included in the second state in the means for initiating the start of the timing period.

4. In a combination as set forth in claim 3, the housing having a first fitting for receiving the input mechanism and having a second fitting for receiving the output mechanism, the second fitting being different from the first fitting.

5. In combination for receiving an input from an input mechanism and for providing an output to an output mechanism, a pyrotechnic device, printed circuit means including electronic circuitry and including the pyrotechnic device for timing a pre-selected period and for firing the pyrotechnic device after the pre-selected timing, a housing for holding the pyrotechnic device and the printed circuit means, a first switch having a movable arm extending through the housing and actuatable to close the switch, second switch means having movable means and having stationary contacts for engagement by the movable means in first and second operative relationships and normally operative in the first relationship for short circuiting the pyrotechnic device and operative in the second relationship for initiating the timing of the pre-selected period and for firing the pyrotechnic device after the timing of the pre-selected period, the housing having a first fitting integral with the housing for receiving the input mechanism, the movable means of the second switch means being accessible to the first fitting for becoming operative in the second operative relationship when the input mechanism is actuated and the first switch is closed, the housing having a second fitting displaced from the first fitting and integral with the housing for receiving the output mechanism, the pyrotechnic device being accessible to the second fitting for producing an actuation of the output mechanism when the pyrotechnic device is fired.

6. In a combination as set forth in claim 5, the printed circuit means including energy storage means connected to the second switch means in the first operative relationship of the second switch means to become short circuited by the second switch means and connected to the second switch means in the second operative relationship of the second switch means to discharge through the pyrotechnic device for firing the pyrotechnic device.

7. In a combination as set forth in claim 5, the housing having a centrally disposed pancake configuration for receiving the printed circuit means and the first fitting extending in one direction from the housing and the second fitting extending in an opposite direction from the housing.

8. In a combination as set forth in claim 5, the printed circuit means including a first printed circuit board for measuring the pre-selected time after the actuation of the input mechanism and including a second printed circuit board for firing the pyrotechnic device after the measurement of the pre-selected time.

9. In a combination as set forth in claim 8, the second printed circuit board including the switch means and the pyrotechnic device and also including energy storage means, the pyrotechnic device and the energy storage means being connected to the second switch means in the first operative relationship of the second switch means to become short circuited by the second switch means, the pyrotechnic device and the energy storage means being connected to the second switch means in the second operative relationship of the second switch means to provide for the firing of the pyrotechnic device by the energy from the energy storage means after the pre-selected time from the closing of the first switch and the actuation of the input mechanism.

10. In combination for receiving an input from an input mechanism and for providing an output to an output mechanism, an energy source, an energy storage member, a pyrotechnic device, first switching means having first and second operative relationships, the first switching means being normally operative in the first relationship, second switching means having first and second operative relationships and operative in the first operative relationship to short the energy source, the energy storage member and the pyrotechnic device and operative in the second relationship to connect the energy source and the energy storage member in a circuit for charging the energy storage member, means for providing an operation of the first switching means in the second operative relationship after a particular time delay to obtain a discharge of the energy storage member through the pyrotechnic device for firing the pyrotechnic device, a housing having first and second openings and having a first fitting in communication with the first opening for receiving an input mechanism and having a second fitting in communication with the second opening for receiving an output mechanism, the energy source, the energy storage member, the pyrotechnic device and the first and second switching means being disposed in the housing.

11. In a combination as set forth in claim 10, printed circuit board means disposed in the housing and holding the energy source, the energy storage member, the pyrotechnic device and the first and second switching means.

12. In a combination as set forth in claim 10, the second switching means including first and second switches each having first and second operative relationships, the first switch providing a closed circuit to the energy source in the first operative relationship to short the energy source and being connected in a circuit with the energy source and the energy storage member in the second operative relationship to provide for a charging of the energy storage member by the energy source, the second switch providing a closed circuit with the pyrotechnic device in the first operative relationship to short the pyrotechnic device and connected in a circuit with the pyrotechnic device and the energy storage member and the first switching means in the second operative relationship of the second switch to provide for a discharge of the energy storage member through the pyrotechnic device and the first switching means in the second operative relationship of the first switching means.

13. In a combination as set forth in claim 10, the energy storage member constituting a capacitor, a resistor connected in the closed circuit with the first switch and the energy source in the second operative relationship of the first switch.

14. In a combination as set forth in claim 12, the energy storage member including a capacitor, and a resistor connected in the closed circuit with the first switch and the energy source in the second operative relationship of the first switch, the first fitting having an individual one of internal and external threads to receive the input mechanism, and the second fitting having the other one of internal and external threads to receive the output mechanism.

15. In a combination as set forth in claim 12, the first switching means constituting at least one transistor non-conductive in the first relationship and conductive in the second relationship.

16. In combination for use with an input mechanism and an output mechanism to provide for an operation of the output mechanism a pre-selected time after the operation of the input mechanism, a housing, switching means having first and second states of operation, a pyrotechnic device, there being openings at spaced positions in the housing for receiving the switching means and the pyrotechnic device, a first fitting extending from the housing for receiving the input mechanism and communicating with a first one of the openings in the housing to provide for a change in the operation of the switching means from the first state to the second state, a second fitting extending from the housing in spaced relationship to the first fitting and communicating with a second one of the openings in the housing for receiving the output mechanism to provide for an actuation of the output mechanism when the pyrotechnic device is fired, and electronic circuitry means disposed in the housing and including the switching means and the pyrotechnic device for preventing the timing of the pre-selected delay from being initiated, and the pyrotechnic device from firing, in the first state of the switching means and for providing for the initiation of the pre-selected timing period in the second state of operation of the switching means and the firing of the pyrotechnic device after the pre-selected timing period.

17. In a combination as set forth in claim 16, the first and second fittings having individual characteristics to provide for a reception of only the input mechanism by the first fitting and a reception of only the output mechanism by the second fitting.

18. In a combination as set forth in claim 16, the switching means including first and second switching means each operative in first and second relationships, the first and second switching means being disposed in the electronic circuitry means to provide for a shorting of the first switching means in the first operative state of the first switching means and to provide for the establishment of a circuit through the pyrotechnic device in the second state of operation of the first switching means and to prevent the measurement of the pre-selected time in the first state of operation of the second switching means and to provide for the measurement of the pre-selected time in the second state of operation of the second switching means.

19. In a combination as set forth in claim 16, the switching means being disposed in communication with the first opening in the housing, the pyrotechnic device being disposed in communication with the second opening in the housing.

20. In combination, a housing having first and second fittings respectively extending from spaced positions in the housing, an input mechanism operatively coupled to the first fitting in the housing, an output mechanism operatively coupled to the second fitting in the housing, first means disposed in the housing for timing a particular delay, second means disposed in the housing in communicating relationship with the first fitting and responsive to the actuation of the input mechanism for initiating the timing of the particular delay by the first means, a pyrotechnic device disposed in the housing in communicating relationship with the second fitting for actuating the output mechanism when fired, and third means disposed in the housing for firing the pyrotechnic device upon the timing of the particular delay by the first means.

21. In a combination as set forth in claim 20 wherein the second means includes switching means having movable means disposed in communicating relationship with the first means for movement from a first position to a second position in response to the actuation of the input mechanism, the switching means being operative in the first position of the movable means to prevent the timing of the particular delay from being initiated and to prevent the firing of the pyrotechnic device and being operative in the second position to provide for the timing of the particular delay and the firing of the pyrotechnic device.

22. In a combination as set forth in claim 20, the first fitting having different characteristics than the second fitting to provide for an operative coupling of the input mechanism only to the first fitting and an operative coupling of the output mechanism only to the second fitting.

23. In a combination as set forth in claim 22, means disposed in the second fitting for amplifying the pyrotechnic effect of the firing of the pyrotechnic device and for introducing the amplified effect to the output mechanism to actuate the output mechanism.

24. In a combination as set forth in claim 20, printed circuit means disposed in the housing, the first, second and third means being included in the printed circuit means.

* * * * *